United States Patent [19]

Ellert

[11] Patent Number: 4,510,737

[45] Date of Patent: Apr. 16, 1985

[54] MACHINE AND METHOD FOR FILLING FLEXIBLE CONTAINERS

[75] Inventor: Roger H. Ellert, San Clemente, Calif.

[73] Assignee: B-Bar-B, Inc., New Albany, Ind.

[21] Appl. No.: 321,153

[22] Filed: Nov. 13, 1981

[51] Int. Cl.[3] ..... B65B 3/04; B65B 43/40; B65B 43/54

[52] U.S. Cl. ..... 53/570; 53/281; 53/283; 53/381 A; 53/255

[58] Field of Search ..... 53/282, 281, 173, 287, 53/300, 468, 469, 449, 471, 255, 480, 492, 381 A, 268, 273, 283, 570, 384

[56] References Cited

U.S. PATENT DOCUMENTS

| | | | |
|---|---|---|---|
| 3,242,951 | 3/1966 | Curie et al. | 53/570 X |
| 3,299,606 | 1/1967 | Weikert | 53/449 |
| 3,306,001 | 2/1967 | Peppler | 53/449 |
| 3,427,646 | 2/1969 | Scholle | 53/468 X |
| 3,447,281 | 6/1969 | Buford et al. | 53/381 A X |
| 3,699,746 | 10/1972 | Titchenal et al. . | |
| 4,120,134 | 10/1978 | Scholle | 53/469 |
| 4,250,691 | 2/1981 | Marshall | 53/300 X |
| 4,297,929 | 11/1981 | Schieser et al. | 53/300 X |
| 4,363,338 | 12/1982 | Brown | 53/492 X |

*Primary Examiner*—Horace M. Culver

*Attorney, Agent, or Firm*—Biebel, French & Nauman

[57] ABSTRACT

A flexible container filling machine handles individual containers by severing the leading container from a continuous web of such containers which is fed into the filling machine. Each container includes a spout communicating with the interior of the container and a cap for closing that spout. The cap and spout of the leading container are pushed to a filling station where they are engaged by a cap handler and spout holder, respectively. The leading container is then severed from the web. A discharge chute, including a releasable container support, is positioned beneath the severed container and a supporting carton is positioned and elevated beneath the discharge chute. The cap is removed from the spout of the severed leading container and the severed container is filled with a metered amount of liquid. The cap is returned to close the filled container. The cap, spout and container support are then released to allow the filled container to fall into the waiting support carton.

4 Claims, 6 Drawing Figures

MACHINE AND METHOD FOR FILLING FLEXIBLE CONTAINERS

BACKGROUND OF THE INVENTION

This invention relates to a machine and method for automatically filling individual flexible containers which are initially connected into a continuous web, and more particularly, to a machine and method wherein the containers are severed from the web prior to being filled and are automatically dispensed into supporting cartons after being filled.

Flexible thermoplastic containers or bags (hereinafter the terms bag and container are used interchangeably) are frequently used to contain fluid materials such as milk, water, fruit juices, wine, chemicals and the like. The use of plastic bags minimizes the exposure of liquids contained therein to contamination and thereby insures a high degree of sanitation and/or purity. However, such flexible bags, particularly in larger sizes, are unwieldy when filled with a liquid. Thus, filled bags are generally placed in supporting containers or cartons which are relatively rigid to facilitate handling of the filled bags.

In the prior art, flexible containers have been connected into a continuous web and automatically filled. Such a filling machine is disclosed in U.S. Pat. No. 4,120,134. In this prior art machine, the containers are filled while connected in the web and severed only after the filled bag has been utilized to advance the web in the filling machine. That is, the gravitational force exerted on each filled bag is utilized to advance the web prior to severing that filled bag from the web.

Known prior art machines are not conveniently adapted to the automatic discharge of filled containers into associate supporting cartons. Such prior art machines require further handling of the unwieldy filled bags to remove the bags from the automatic filling machine and place one or more of the filled bags into a supporting carton. The handling of filled flexible containers in this manner is difficult because of their unwieldy nature.

Accordingly, the need exists for a machine and method for automatically filling flexible containers which does not require the handling of unpackaged filled flexible containers and which otherwise avoids the disadvantages of the prior art machines and methods.

SUMMARY OF THE INVENTION

The machine and method for filling flexible containers in accordance with the present invention improves upon the prior art by automatically handling individual containers severed from a web of such containers and automatically depositing those containers into supporting cartons after they have been filled.

Flattened flexible containers including spouts communicated with the container interiors are initially connected into a continuous web which is fed to the filling machine. In the preferred embodiment, the containers are received with separable closing devices or caps connected to and closing the spouts to prevent contamination of the container interiors. The web of containers is received by the filling machine and positioned by guide rails which engage the individual spouts of the containers. The spout of the leading container is positioned beyond a pusher device which engages the spout and pushes the continuous web of containers so that the spout of the leading container is positioned adjacent to a filling station. At the filling station, the spout is engaged by a first set of clamping members or jaws and the cap is engaged by a second set of clamping members or jaws. The second clamping members remove the cap from the spout so that the container can be filled while the container is severed from the web of containers. The first clamping members engage the spout with a filling device which meters a defined amount of liquid into the container. The filled container is separated from the filling device and the cap is repositioned by the second clamping members to close the spout. The bags are thus conveniently transported to the filling machine in a continuous web of containers but individually filled and handled by severing each container from the web prior to filling.

Advantageously, in accordance with one feature of the present invention, a discharge sleeve or chute is provided below the container which has been severed from the web and is to be filled. A relatively rigid container or carton is positioned below the discharge sleeve for receiving and supporting the flexible container after it has been filled. As the flexible container is filled, the force of gravity acting on the liquid in the expanding container urges the container into the discharge sleeve. A releasable support is disposed within the discharge sleeve to support the container while it is being filled. After the flexible container has been filled with a preset amount of liquid, the cap is replaced on the spout and the container spout and support are released to permit the filled container to fall into the waiting carton. The supporting carton containing the filled bag is expelled from the filling machine to a transporting device such as a roller conveyor positioned adjacent to the machine. The discharge sleeve expands outwardly from the top to the bottom of the sleeve. This inverted funnel formation for the discharge sleeve facilitates the automatic loading of the flexible containers into the supporting cartons.

The method in accordance with the present invention provides for filling individual flexible containers severed from a continuous web. Each container includes a spout communicating with the interior of its associated container and the spouts are formed to receive a closing device or cap. The method comprises the steps of pushing the web of containers to a position where the spout of the leading container is adjacent to a filling station; severing the leading container from the web; filling the severed container through its spout; and enclosing the spout with a cap.

Advantageously, in accordance with one feature of the method, the filled containers can be automatically loaded into supporting cartons by providing a discharge chute beneath the severed container; positioning a carton beneath the discharge chute to receive the severed container after it has been filled; and ejecting the supporting carton which contains the filled container.

Furthermore, automatically loading filled containers into supporting cartons is facilitated by the steps of supporting the severed container within the discharge chute while the container is being filled; and discharging the severed container from the discharge chute after it has been filled and capped.

It is an object of the present invention to provide an improved machine and method for automatically filling flexible containers after they have been severed from a continuous web of such containers to prevent contamination.

It is another object of the present invention to provide a machine and method for filling flexible containers severed from a continuous web of such containers and depositing those containers when filled into supporting cartons for ease of handling and processing.

It is a further object of the present invention to provide an improved machine and method for filling flexible containers severed from a continuous web of such containers and releasably supporting the severed bags so that they can be discharged into a supporting carton after the bags are filled and capped.

These, as well as other objects and advantages of the present invention, will become more apparent from the following description when read with reference to the accompanying drawings.

DETAILED DESCRIPTION OF THE INVENTION

The general operation of the filling machine of the present invention will now be described with reference to FIG. 1 which is a perspective view of two container filling machines 102, 104 in accordance with the present invention. Two machines are shown to illustrate the different size supporting cartons which can be used in the present invention and the multiple set up of such filling machines. The machines 102, 104 are essentially identical to each other and so only one machine will be described.

Figure 2:
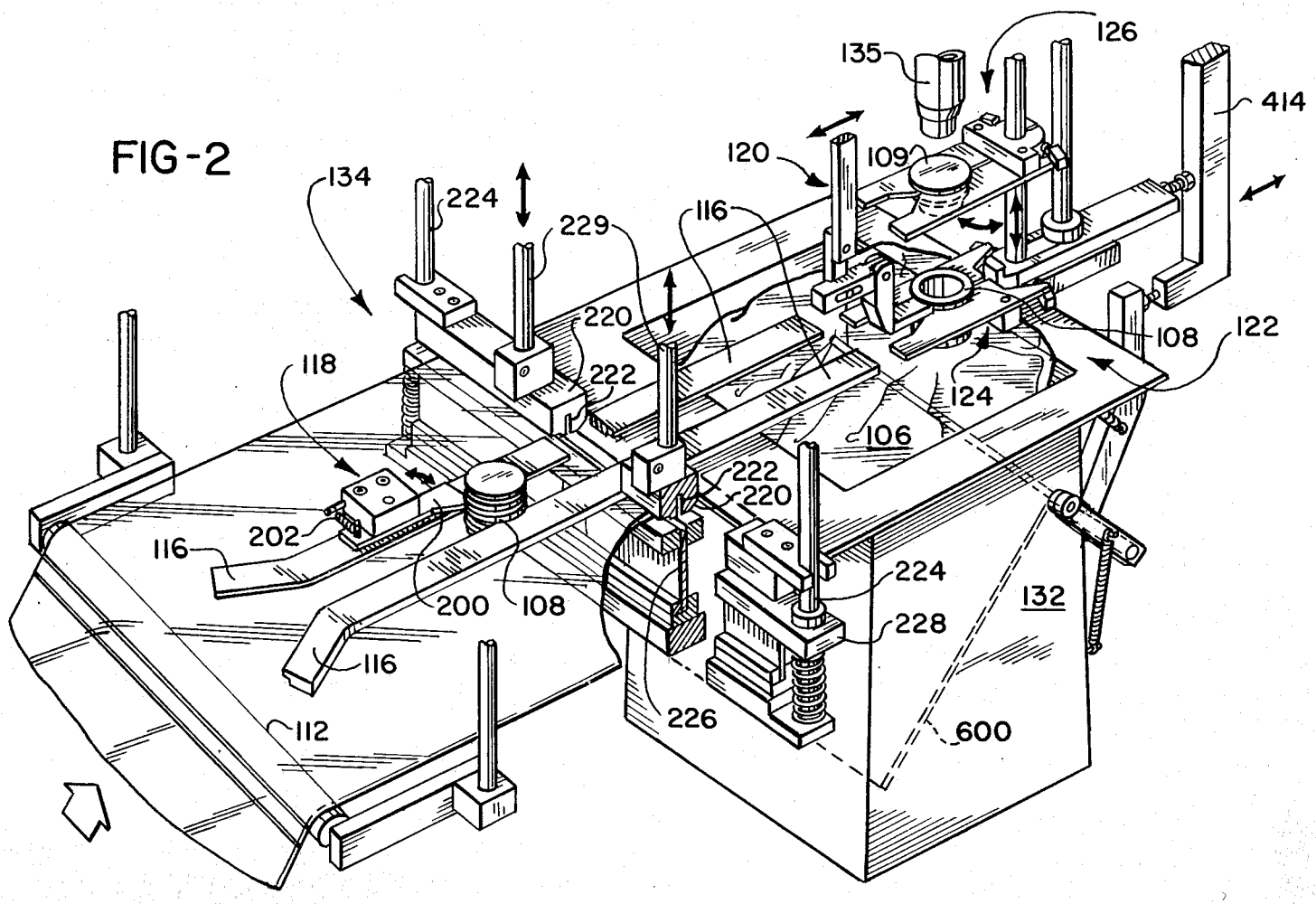
FIG. 2 is a diagrammatic perspective view of the bag handling portion of a filling machine in accordance with the present invention.

Flexible containers 106 are fan-folded or otherwise packaged in a supply means such as boxes 107 for use in the filling machine. It is to be understood that various sizes of flexible containers can be utilized by minor adjustments of the machine. As disclosed, each container 106 includes a spout 108 which is positioned nearer to the leading end of the container, i.e., the end fed into the machine, than to the trailing end. Each spout 108 is closed by a closing device or cap 109 which fits onto the spout 108. The containers 106 are separated from each other in the web by intermittent blank sections 110 of flexible film. These blank film sections 110 are severed to separate the bags from one another. The continuous web comprising the containers 106 is fed over a roller 112 and onto a supporting platform (not shown). The spouts 108 are received between guide rails 116 to position the containers 106 in the filling machine. The containers are initially manually fed into the machine until the spout 108 of the leading container is snapped behind a container retaining mechanism 118, as seen in FIG. 2, which prevents the containers from sliding back into the box 107.

Presuming that the filling machine has already been connected to a source of liquid (not shown) to be placed into the containers 106 and a source of motive power (not shown), such as electricity and/or compressed air, the machine is ready for operation. A bag pusher 120 is moved behind the spout 108 which is held by the bag retainer 118. The pusher 120 then pushes the spout of the leading container 106 toward the filling station 122 where the spout 108 is engaged by a spout holder 124 and the cap 109 or closure device is engaged by a cap handler 126 which engages the cap 109, removes it from the spout 108 before filling, and replaces it afterward. The motion of the leading container 106 toward the filling station 122 advances the web of containers 106 so that the spout of the next container in line is snapped into the bag retainer 118.

Cartons 128 of varying sizes, dependent upon the flexible container to be supported and the desired final shape of the product, are transferred to the filling machine on conveyors 130. When the leading carton 128 has been advanced under a container discharge chute 132, an elevator 133 located under the discharge chute 132 is activated to raise the carton and surround the discharge chute 132. The elevator 133 is shown in its elevated position in FIG. 6.

The engagement of the cap by the cap handler 126 is sensed together with the proper positioning of the carton 128 beneath the discharge chute 132 to activate the container filling cycle of the machine. The sensing of the proper positioning of the container to be filled and the carton are by contact with electrical switches (not shown) or by other well known proximity sensing means. Of course, the engagement of either the spout or cap or both could be sensed to enable the filling cycle. The cap 109 is then lifted and removed from the spout 108 by the cap handler 126 which is raised and rotated to one side. While the cap 109 is being removed from the spout 108, a knife assembly 134 is concurrently operated to separate the leading container 106 from the web of containers by severing the blank section of film 110 which connect the two. The severed bag is disposed over an opening to the discharge chute 132.

Figure 6:
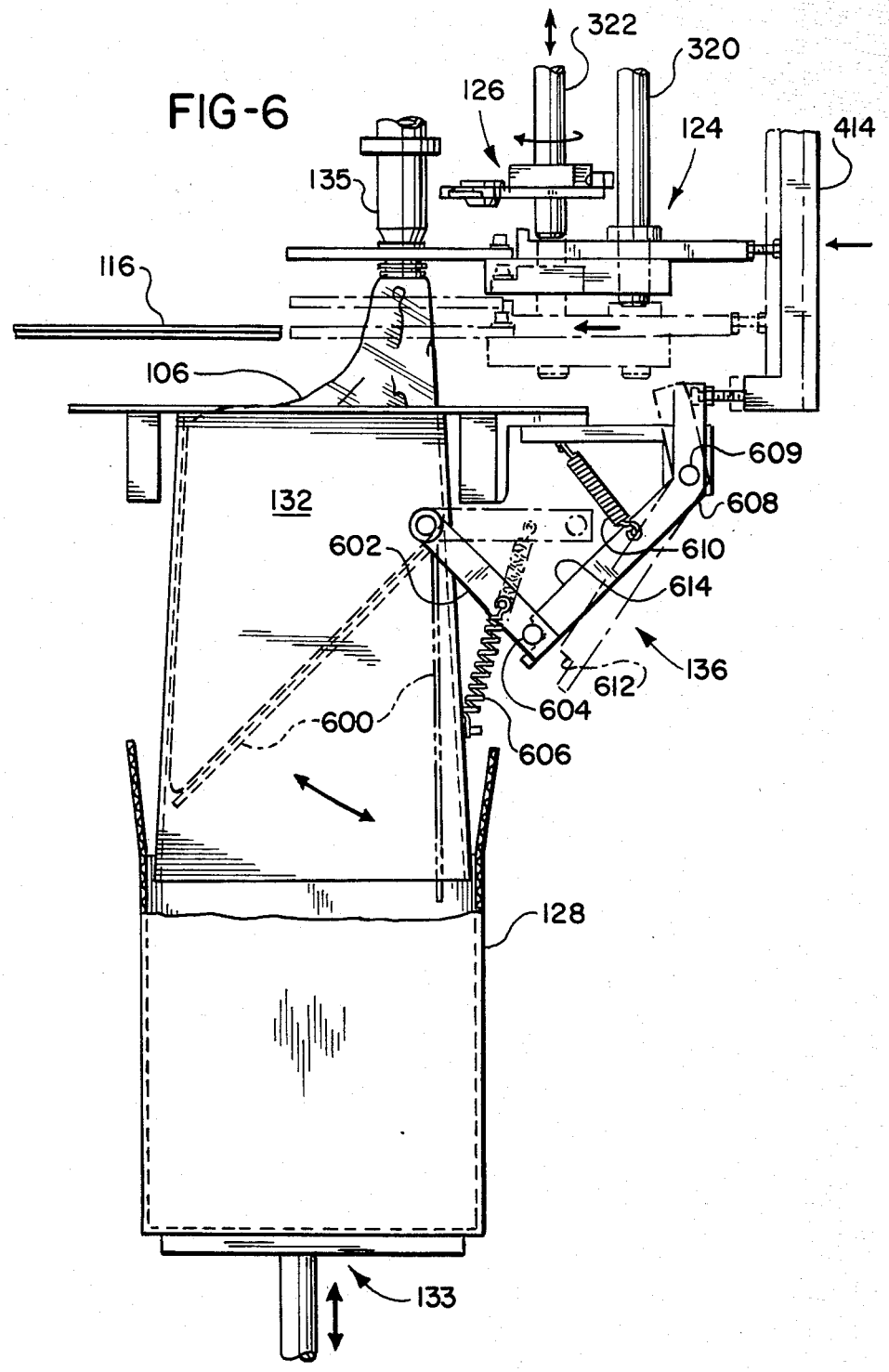
FIG. 6 is a partially sectioned side view through the discharge chute of the present invention showing the container supporting mechanism of the present invention.

After the leading container has been severed from the web and its cap has been removed by the cap handler 126, the bag and spout are raised by the spout holder 124 into engagement with filler tube 135 (see FIGS. 2 and 3) through which a defined amount of liquid is metered into the container. As the container fills, it is urged into the discharge chute 132 by the force of gravity on the liquid filling the container. Also, as the container is filled and progresses into the discharge chute 132, a container supporting device 136, as seen in FIG. 6, supports the container until it is completely filled.

Figure 1:
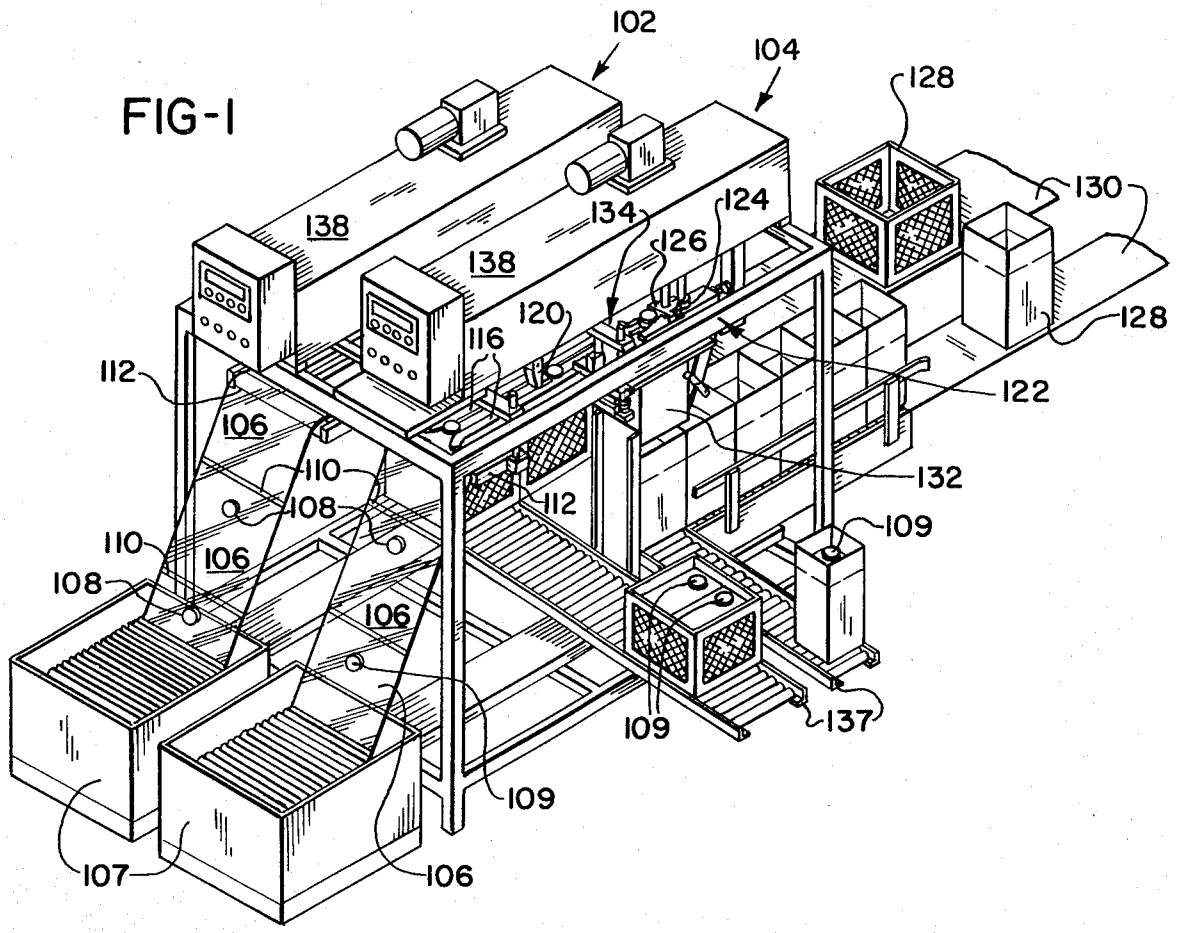
FIG. 1 is a perspective view of two container filling machines in accordance with the present invention.

When the bag is completely filled, the spout holder 124 and the cap handler 126 are concurrently lowered into the position shown in FIG. 1 to replace the cap 109 onto the spout 108 of the container 106 thereby closing the container. As the spout holder 124 and the cap handler 126 return to their lowered position, both devices are released together with the container supporting device 136. Since all support has been removed from the filled bag, it drops through the discharge chute 132 into the associated carton 128. The carton containing the filled bag is lowered to the position shown in FIG. 1 and ejected onto exit conveyor 137. It may be noted from FIG. 1 that two bags may be deposited into the same carton. In this case, the carton is moved for proper positioning under the associated discharge chute for each bag to be deposited into the carton.

The appropriate mechanical driving mechanism for the bag handling machines is enclosed by housings 138. In the preferred embodiment of the present invention, the mechanism comprises various cams and activating levers to generate the described motions. Such cam driven mechanical machines are well known in the prior art and provide the advantage of being initially set at the factory and requiring little or no adjustment while in operation. Of course, other known mechanical devices can be utilized in the present invention.

FIG. 2 is a diagrammatic perspective view of the bag handling portion of the filling machine showing the orientation of the devices operating on the containers during the bag filling operation. The containers 106 are drawn into the machine from the left, as shown in FIG. 2, and the spout 108 of the bag which is the container next to be carried to the filling station 122 is latched behind the bag retainer 118. The spout of a bag closer to the box 107 could be retained, however, the illustrated arrangement helps insure proper engagement of the spout by the pusher 120.

The bag retainer 118 includes a single pawl 200 mounted on one of the guide rails 116. Of course, two pawls could be provided with one mounted on each of the guide rails 116. The pawl 200 is biased by a spring 202 so that as a spout is pushed beyond the pawl 200, the spout snaps into position ahead of the pawl which then prevents the spout and associated web of containers from returning to the box 107.

The knife assembly 134 is positioned between the bag retainer 118 and the filling station 122 and comprises upper dies 220 which include slots 222 running the length of the dies. The dies 220 are supported on two rods 224 mounted on either side of the filling machine. The rods 224 also support a serrated blade 226 located beneath the bag supporting table and the blade is protected by a spring loaded blade guard 228. The dies 220 are mounted for vertical motion on the rods 224. When the leading bag has been placed in position with its spout under the filler tube 135, one of the blank sections 110 of flexible film is positioned between the dies 220 and the serrated blade 226. As the cap is removed by the cap handler 126, the dies 220 are lowered by rods 229 forcing the blade guard 228 down and exposing the serrated blade 226 which extends into the slots 222 of the dies 220. The blank section of flexible film 110 is thus cut by the serrated blade 226 as it extends into the slots 222 of the dies 220.

The positioning of the bag retainer 118 and the knife assembly 134 relative to one another and the remainder of the machine can be adjusted for operation with varying container sizes. The remainder of FIG. 2 shows the general orientation of the machinery for manipulating the cap, spout and the flexible bags during the filling procedure.

Figure 3:
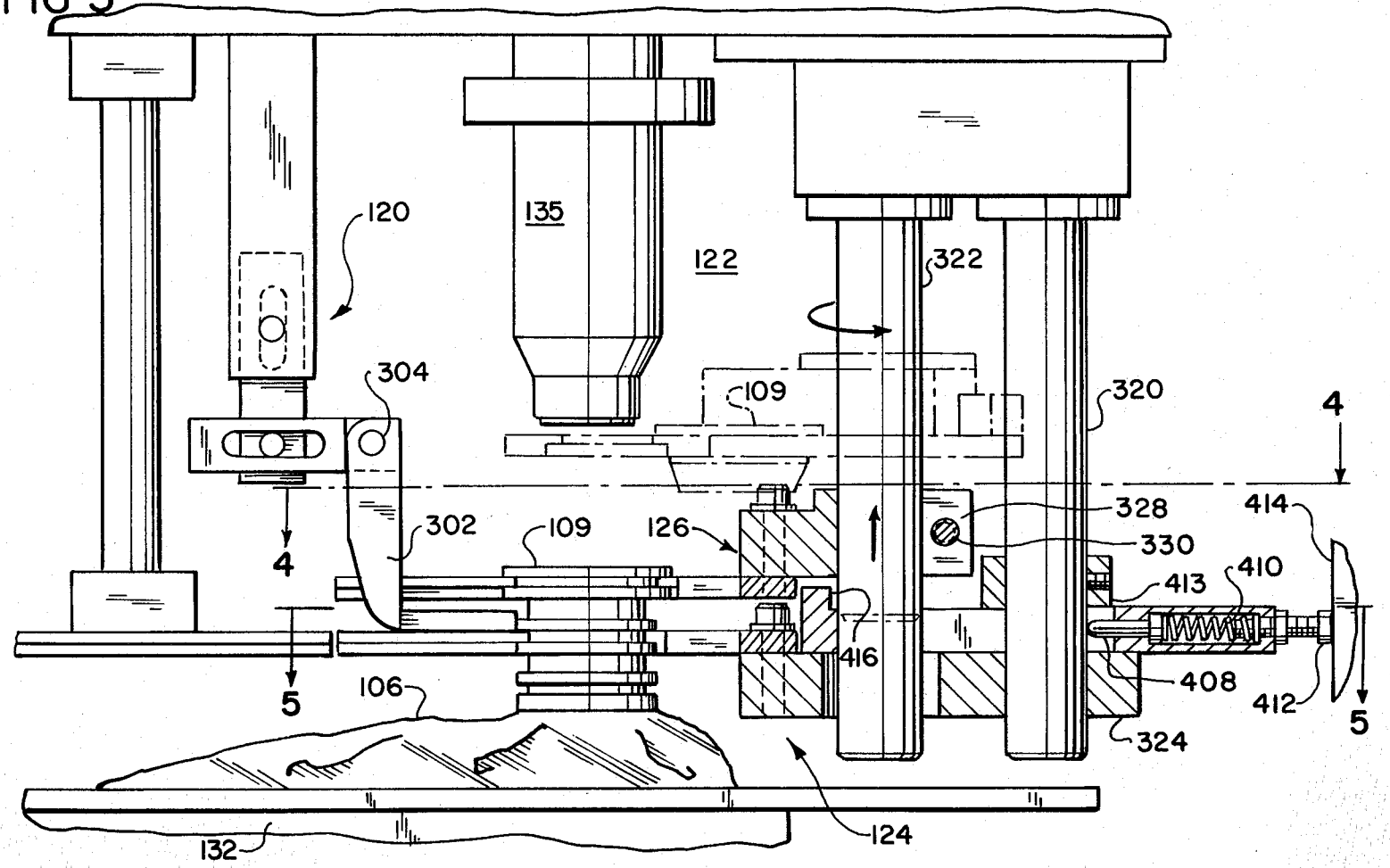
FIG. 3 is a partially sectioned side view of the container filling station of the present invention.

FIG. 3 is a partially sectioned side view showing greater detail of the filling station 122 of the machine. The bag pusher 120 comprises a pivoting arm 302. When the bag pusher 120 is moved to the left, as shown in FIG. 3, to engage the next container 106 of the web of containers 106 coming from the box 107, the arm 302 pivots about a pin 304 so that the arm 302 rises up in a counter-clockwise direction to clear the spout and associated cap. The bag pusher 120 is moved to a position sufficiently far behind the spout of the bag so that the arm 302 falls behind the spout 108 which is being retained by the bag retainer 118. Since the arm 302 will only pivot in a counter-clockwise direction, as the bag pusher 120 is returned toward the spout holder 124 and the cap handler 126, the arm 302 engages the spout 108 and advances it into engagement with those devices.

The spout holder 124 is firmly mounted to a cylindrical shaft 320 which is in turn mounted for vertical movement in the direction of the axis of the shaft 320 under the control of cam and lever or other mechanical movement apparatus. The cap handler 126 is firmly mounted to a cylindrical shaft 322 which is supported for both vertical movement along its axis and rotational movement about its axis. The spout holder 124 comprises a generally T-shaped base member 324 which is secured to the cylindrical shaft 320 by appropriate fastener means. The cap handler 126 comprises a base member 328 which is mounted by a bolt 330 or other connecting device to shaft 322. The cap handler 126 is shown in a partially raised and partially rotated position in a phantom view in FIG. 3.

Figure 4:
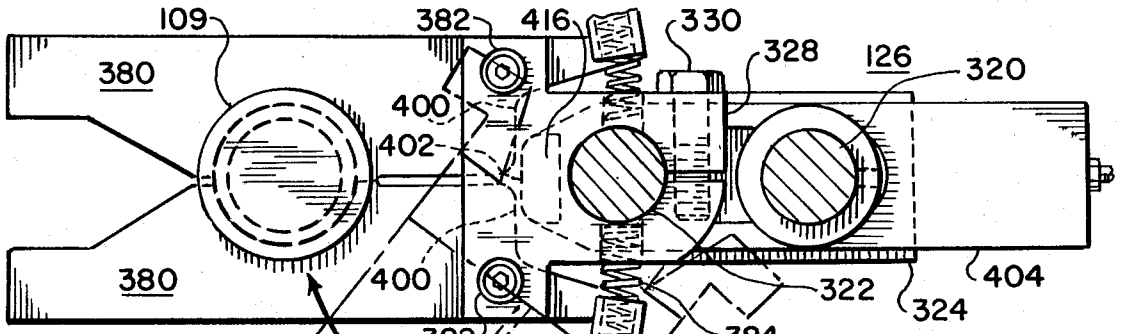
FIG. 4 is a sectional view taken along line 4—4 of FIG. 3 showing the cap handling mechanism of the present invention.
Figure 5:
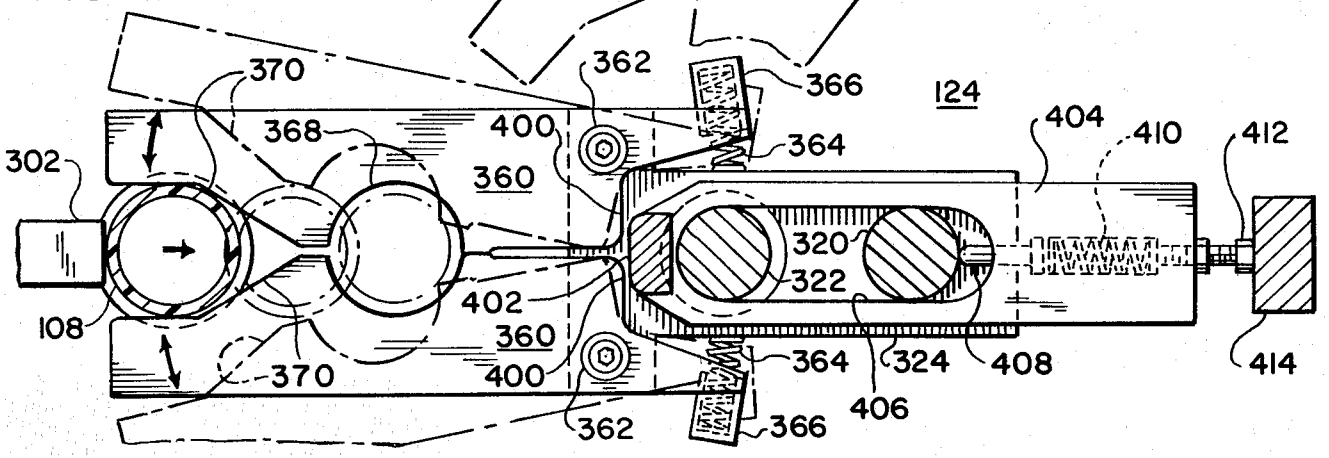
FIG. 5 is a sectional view taken along line 5—5 of FIG. 3 showing the spout handling mechanism of the present invention.

With reference to FIGS. 4 and 5, which respectively show the top plan view of the cap handler 126 and the spout holder 124, the spout holder 124 comprises two spout gripping jaws 360 which are mounted to the member 324 by bolts 362 about which the jaws 360 can pivot. The jaws 360 are held in a closed position, as shown by the solid line drawing of FIG. 5, by springs 364 which are held by spring retainers 366 to oppose the opening of the jaws 360. When the jaws 360 are closed, a generally circular aperture 368 is formed for receiving and holding the spout 108 of a container 106 to be filled.

The forward ends of the jaws 360 are aligned with the guide rails 116 which guide the spout 108 into the angular openings 370 of the jaws 360. Thus, as the pusher 120 pushes a spout 108 into the jaws 360 of the spout holder 124, the jaws 360 are opened by the engagement of the spout 108 with the angular openings 370 of the jaws 360. The jaws 360 open by pivoting about the bolts 362 against the force of the springs 364 which are compressed by the opening of the jaws. Once the spout 108 is located within the aperture 368 of the jaws 360, the jaws 360 snap closed to engage and hold the spout.

The cap handler 126 comprises jaws 380 which are similarly pivotally mounted by bolts 382 connected to the member 328. The jaws 380 are similarly held in a closed position by springs 384 which are held by spring retainers 386. The jaws 380 are operated by the cap 109 on the spout 108 in a manner similar to the operation of the jaws 360 of the spout holder 124. Thus, as the spout 108 and its associated cap 109 are moved into position under the filler tube 135, the spout and its associated cap are snapped respectively into the jaws 360 and 380. To insure positive clamping of the spout 108 and cap 109, a mechanical locking member can be selectively inserted to block the compression of the springs 364, 384 and consequently the opening of the jaws 360, 380.

The jaws 360 and 380 are opened after the container has been filled and the cap 109 has been replaced on the spout 108 of the container 106. The jaws 360 and 380 include lobes 400 which are engaged by a cam surface 402 to open the jaws 360, 380. The cam surface 402 is mounted on a generally rectangular block 404 having an oblong aperture 406 which surrounds the cylindrical shafts 320 and 322. The oblong aperture 406 has a major axis which extends beyond the outer surfaces of the cylindrical shafts 320 and 322. A pin 408 is forced into the end of the oblong aperture 406 by a spring 410 to maintain the opposite end of the oblong aperture 406 in sliding engagement with the cylindrical shaft 322. The spring tension of the spring 410 can be adjusted by the bolt 412 which is threadingly engaged with the block 404. The block 404 is held in place on the shaft 320 by a collar 413.

A control member 414 is driven against the bolt head 412 to force the generally rectangular member 404 into the jaws 360 and 380 against the force of the spring 410 which is transmitted through the pin 408 to the cylindrical shaft 320. The forward end of the generally rectangular block 404 is tapered to define the cam face 402 which engages the lobes 400 to open the jaws 360. A generally rectangular upward extention 416 extends the cam face 402 so that it engages the lobes 400 of the jaws 380, whereby the jaws 360, 380 are opened at the same time by motion of the block 404.

FIG. 6 shows the structure of the discharge chute 132 and the container supporting device 136. The container supporting device 136 comprises a bag support plate 600 which is positioned within the discharge chute 132. The plate 600 is hingedly mounted to the exterior of the discharge chute to present minimum resistance as a filled bag is discharged therefrom. The support plate 600 is pivoted between a raised bag supporting position and a lowered bag discharge position. A lever arm 602 is connected to the bag support plate 600. The lever arm 602 includes a latching pin 604 and is biased to maintain the bag support plate 600 in the bag supporting position by a spring 606 which extends between the discharge chute 132 and the lever arm 602. An angularly shaped lever arm 608 is hingedly supported to the frame of the machine by bolt 609 and the lower end of the lever arm 608 is biased toward the discharge chute 132 by a spring 610. The angled lever arm 608 includes a notch 612 which receives the latching pin 604 of the lever arm 602.

The control member 414 which opens the jaws 360, 380 of the spout holder 124 and the cap handler 126 is extended to engage the angled lever arm 608. Activation of control member 414 releases the latch pin 604 from the notch 612 to allow the bag support plate 600 to pivot downwardly under the weight of a filled container 106, contained within the disharge chute 132 and against the force of the spring 606. After the angled lever arm 608 has been activated to the position shown in phantom in FIG. 6, to discharge a completely filled container 106, the control member 414 is returned to its rest position. The upper surface 614 of the angled lever arm 608 engages the latch pin 604 of the lever arm 602 to assist the opening of the bag support plate 600 and the discharge of the filled container 106 from the discharge chute 132 into the raised carton 128.

After the filled container 106 is thus discharged or dropped into the carton 128, the force of the spring 606 is sufficient to return the plate 600 to the raised bag supporting position. The latching pin 604 is engaged by the notch 612 of the angled lever arm 608 to once again rigidly support the plate 600 in a container supporting position across the discharge chute 132. The elevator 133 for raising the carton 128 to surround the discharge chute 132 is shown in FIG. 6 and can be operated by any appropriate mechanical mechanism.

The overall operation of the filling machine in accordance with the present invention can now be described with reference to the drawings. The leading container 106 of the web of containers extending from the box 107 was previously advanced to a position where its spout 108 was engaged by the bag retainer 118. The pusher 120 is moved to a position where its arm 302 has pivoted up and over the spout 108 and is positioned behind the spout. The pusher 120 pushes the spout 108 from the bag retainer 118 toward the filling station 122, thus advancing the leading container 106 as well as the web of containers. The spout 108 and associated cap 109 of the leading container are pushed into the waiting jaws 360, 380 of the spout holder 124 and the cap handler 126, respectively, and are engaged thereby.

The next container of the web of containers is advanced to a position where its spout 108 is snapped ahead of the bag retainer 118 by the action of the pusher 120 on the leading bag. The cylindrical shaft 322 is raised to remove the cap from the spout 108. The shaft 322 is then raised further and rotated so that the jaws 380 of the cap handler 126 are moved to a side position to prevent interference with the operation of the spout holder 124 to fill the container. While the cap handler 126 is thus operating, the knife assembly 134 is activated to sever the leading bag from the web of bags extending from the box 107.

Before the severed bag can be filled, a carton 128 must be positioned beneath and elevated to surround the discharge chute 132. Once a carton has been so positioned, the filling of the container commences by vertical motion of the cylindrical shaft 320 raising the spout holder 124 the jaws 360 of which engage the spout 108 of the severed container. Thus, the spout 108 of the severed container is raised to engage the filler tube 135 where a defined amount of liquid is metered into the severed container through the spout 108. As the severed container is being filled, the force of gravity urges the container and the increasing amount of liquid into the discharge chute 132 where it is supported by the bag support plate 600.

Once the defined amount of liquid has been filled into the container 106, the flow of liquid is stopped and the spout holder 124 and the cap handler 126 commence to return to their lower position. As the cap handler approaches its lowered position, the cap is repositioned onto the spout to close the container which was just filled. After the cap has been firmly reseated upon the spout 108, the control member 414 advances to bear against the bolt 412 and the angled lever arm 608. The action of the control member 414 advances the block 404 to engage the cam surface 402 with the lobes 400 of the jaws 360, 380 of the spout holder and cap handler. Simultaneously, the angled lever arm 608 is being moved to release the latch pin 604 of the lever arm 602. Thus, the cap and spout of the filled container are released. Concurrently, the support plate 600 is released to discharge the filled bag into the waiting carton 128. The carton thus containing the filled bag is lowered and ejected onto the waiting conveyor 137. The sequence is then reinitiated to fill the next bag of the continuous web of bags.

While the method herein described and the apparatus for carrying out this method constitute preferred embodiments of the present invention, it is to be understood that the invention is not limited to this precise method and apparatus and that changes may be made in either without departing from the true spirit and scope of the invention as defined in the appended claims.

What is claimed is:

1. Apparatus for filling individual flexible containers severed from a continuous web of said containers and depositing containers so filled into supporting cartons, said containers each including a spout communicating with the interior of its associated container and having a separable capping device connected to said spout, said apparatus comprising:

means for receiving said continuous web of containers from a supply force, including means for engaging the spouts of said containers to position and align said web of containers and means for retaining said web of containers within said apparatus;

pusher means adapted to engage the spout of the leading container of said web for advancing said web so that the the spout of said leading container is positioned at a filling station;

container separating means for severing said leading container from said web;

filling means at said filling station for filling said severed leading container;

cap handling means for removing said capping device from said leading container prior to being filled and for replacing said capping device onto said leading container after it has been filled;

container discharge means, expanding in cross-sectional area toward the discharge end, for discharging a filled container under the influence of gravity; and carton receiving means positioned under said discharge means for positioning a rigid carton such that the open end of said carton surrounds the expanded cross-sectional area end of said discharge means so as to receive a filled container within said carton.

2. The apparatus of claim 1 wherein said carton receiving means comprises elevator means for raising and lowering said carton relative to said discharge means.

3. The apparatus of claim 2 wherein said discharge means comprises a support means releaseably supported across said discharge means for supporting said severed container during filling and for discharging said container after it has been filled so that said filled container falls from said discharge means.

4. The apparatus of claim 3 further including means for ejecting cartons containing filled containers from said apparatus.

* * * * *

UNITED STATES PATENT AND TRADEMARK OFFICE

CERTIFICATE OF CORRECTION

PATENT NO. : 4,510,737

DATED : April 16, 1985

INVENTOR(S) : Roger H. Ellert

It is certified that error appears in the above—identified patent and that said Letters Patent is hereby corrected as shown below:

Column 9, line 7 (claim 1), "force" should read --source--.

Signed and Sealed this

*Sixth* Day of *May 1986*

[SEAL]

*Attest:*

DONALD J. QUIGG

*Attesting Officer*

*Commissioner of Patents and Trademarks*